US005383287A

United States Patent [19]

Kuhasalo

[11] Patent Number: 5,383,287

[45] Date of Patent: Jan. 24, 1995

[54] METHOD AND WIRE GROUP IN A DRYER SECTION PROVIDED WITH A SINGLE-WIRE DRAW

[75] Inventor: Antti Kuhasalo, Jyväskylä, Finland

[73] Assignee: Valmet Paper Machinery Inc., Helsinki, Finland

[21] Appl. No.: 72,335

[22] Filed: Jun. 3, 1993

[30] Foreign Application Priority Data

Jun. 3, 1992 [FI] Finland ..... 922560

[51] Int. Cl.[6] ..... F26B 11/02

[52] U.S. Cl. ..... 34/117; 34/120; 34/114

[58] Field of Search ..... 34/114, 115, 116, 117, 34/120, 121, 123, 243 F, 447

[56] References Cited

U.S. PATENT DOCUMENTS

| | | | |
|---|---|---|---|
| 3,699,663 | 10/1972 | Candor et al. | 34/123 X |
| 4,186,780 | 2/1980 | Josef et al. | 139/383 A |
| 4,446,187 | 5/1984 | Eklund | 428/136 |
| 5,022,163 | 6/1991 | Ilvespaa et al. | 34/23 |
| 5,024,729 | 6/1991 | Kuhasalo et al. | 162/372 |
| 5,062,216 | 11/1991 | Hannigan | 34/117 X |
| 5,172,491 | 12/1992 | Ilvespaa et al. | 34/115 |

FOREIGN PATENT DOCUMENTS

| | | |
|---|---|---|
| 0227442 | 7/1987 | European Pat. Off. . |
| 82849 | 1/1991 | Finland . |
| 83680 | 4/1991 | Finland . |
| 732814 | 9/1932 | France . |
| 2407921 | 5/1979 | France . |
| 227396 | 7/1957 | Sweden . |
| 429769 | 10/1981 | Sweden . |
| 9104374 | 4/1991 | WIPO . |

*Primary Examiner*—Denise L. Gromada
*Attorney, Agent, or Firm*—Steinberg, Raskin & Davidson

[57] ABSTRACT

The invention relates to a method and a wire group in a drying section provided with single-wire draw in a paper machine or paper finishing machine. A paper web to be dried is passed on support of a drying wire alternatingly over heated cylinder faces of drying cylinders and over leading rolls or other equivalent drying cylinders. The paper web is pressed into direct contact against the heated cylinder face of the drying cylinders and, on the leading rolls, the paper web is placed on the outside face of the drying-wire loop at a side of the outside curve. In the invention, the difference in speed of the paper web which the paper web would have during operation of the drying section on the turning sectors of the drying cylinders and the leading rolls is reduced by dimensioning of the structure of the drying wire in the direction of thickness and by selecting appropriate materials for the structure of the drying wire.

20 Claims, 4 Drawing Sheets

METHOD AND WIRE GROUP IN A DRYER SECTION PROVIDED WITH A SINGLE-WIRE DRAW

BACKGROUND OF THE INVENTION

The invention relates to a method in a dryer section provided with a single-wire draw in a paper machine or a paper finishing machine, wherein a paper web to be dried is passed on support of a drying wire alternatingly over heated cylinder faces of drying cylinders and over leading rolls or equivalent. On the drying cylinders, the paper web is in direct contact against the heated cylinder face and, on the leading rolls, the paper web is placed on the outside face of the drying-wire loop at the side of the outside curve.

Further, the invention relates to a wire group in a multi-cylinder dryer in a paper machine, comprising one or several smooth-faced and solid-mantle heated drying cylinders and leading rolls or equivalent drying cylinders placed at in proximity thereto. The wire group comprises a drying-wire loop guided by guide rolls and arranged to be curved over the drying cylinders and leading rolls so that the drying cylinders are placed outside the drying-wire loop and the leading rolls are placed inside the drying-wire loop. The drying wire is fitted to press the paper web to be dried against the heated cylinder faces of the drying cylinders, while the paper web is fitted to curve on the outside face of the drying wire over the leading rolls when the paper web runs from a preceding drying cylinder onto a subsequent drying cylinder.

In multi-cylinder dryers of a paper machine, during the passing of the paper web through the paper machine, either a so-called twin-wire draw and/or a single-wire draw is/are used. In a twin-wire draw, the heated drying cylinders are arranged in two horizontal rows placed one above the other, the successive cylinders in the rows being placed in an interlocking relationship, i.e., interlocked, in the upper and lower rows. In such a case, in each cylinder group, there are two drying wires, a so-called upper wire and a lower wire, by whose means the paper web is pressed against heated drying-cylinder faces. The upper and lower wires are guided by guide rolls placed in the gaps between the cylinders. In a twin-wire draw, the web has usually free, unsupported draws as it runs and meanders between the rows of cylinders.

Recently, in dryers, a single-wire draw has become more common, wherein only one drying wire is employed in a cylinder group. The paper web runs through the whole group on support of this single wire. In earlier embodiments of paper machines employing a single-wire draw, two rows of drying cylinders were commonly employed, one row being placed above the other. However, at present, only one row of drying cylinders is employed so that the other row generally consists of unheated leading rolls or cylinders. The drying cylinders, leading rolls, and the drying wire are arranged so that the drying wire presses the web to be dried against the cylinder face and, on the leading rolls, the web is placed at the side of the outside curve. The leading rolls are usually placed inside the drying-wire loop.

In dryer sections provided with a single-wire draw, the leading rolls are typically suction rolls, and preferably suction rolls provided with a grooved outer mantle, marketed by the assignee under the trade mark "VACROLL". By means of the suction effect in these suction rolls, the adhesion of the paper web to the outer face of the drying wire on the reversing sectors of the suction-leading rolls is promoted.

When compared with drying sections having a twin-wire draw, it is a substantial advantage of a single-wire draw that free, unsupported draws of the paper web can be avoided. For this reason, a single-wire draw is commonly employed, in particular, near the forward end of the dryer section where the web has a higher moisture content and is, thus, of lower strength and more susceptible of breaks and stretching.

Recently, a type of dryer section which has also become more common, is one in which exclusively drying groups with a single-wire draw are employed. In such embodiments, it is possible to use either so-called normal groups, in which the drying cylinders are placed in the upper row and the leading rolls in the lower row, or it is additionally possible to employ some so-called inverted groups, in which the cylinders and the leading rolls are placed one above the other in the reversed sequence, i.e., drying cylinders in the lower row and leading rolls in the upper row. In a typical dryer section provided with only a single-wire draw, there are, e.g., about seven successive wire groups.

In dryer sections having a single-wire draw, above all in the wire groups arranged towards the rear end of the dryer section, glazing and wearing in the face of the drying wire placed at the side of the paper has been noticed to be stronger than average. It has also been noticed that the reason for this increase is the speed difference between the wire and the paper web arising in single-wire draw. This speed difference always arises in situations in which the paper web is alternately placed outside the wire and between the wire and the roll as it runs on the face of the same drying wire or felt. The manner in which the difference in speed arises will be described in more detail later with reference to the figures in the accompanying drawing.

It is significant problem that the difference in speed between the paper and the wire produces a sort of "grinding" between them which abrades the surface portion of the wire placed at the side of the paper. This effect may also produce detrimental changes in the quality properties of the paper face.

In the initial end of the dryer section, where the paper web has a higher moisture content and is therefore more elastic, the deformations of the paper web are usually capable of compensating for the effect caused by the difference in speed between the wire and the paper. However, when the paper runs further in the dryer section and becomes dry, its elasticity becomes lower at the same time as the paper web shrinks to some extent. For example, in a dryer section such as mentioned above, e.g., one provided with seven single-wire groups, the dry solids content at the beginning of group 6 is in a range from about 65% to about 70% and at the end of the dryer section, the dry solids content is in a range of from about 90% to about 98%. In this range of dry solids content, the elasticity of the paper is no longer sufficient to compensate for the above drawbacks arising from the differences in speed between the drying wire and the paper web.

The afore-mentioned problems related to the increased wear of the wire to a level considerably higher than average, usually increase steeply and become a significant drawback when the dry solids content of the paper web is higher than from about 60% to about 65%.

The differences in speed between the wire and the paper web may also cause problems of other sorts, such as dust formation in the paper and, with some paper grades, also other detrimental factors, mainly related to the quality of the paper. Also, the tightening of a relatively dry web inside a wire group causes problems in the runnability of the web, e.g., in the form of web breaks. Such web breaks may cause undesirable standstills.

As will be described later in connection with an explanation of the formulae of calculation set forth below and from the exemplifying illustrations, it is possible to reduce the difference in speed between the paper to be dried and the supporting drying wire by making the drying wire thinner. This aspect has also been experimented with in some places to reduce the problems described above. However, in the manufacture of a sufficiently thin drying wire, considerable difficulties are encountered, because the manufacture and operation of a wire of a thickness of, for example, about 1.1 mm is already "fine art", whereas the manufacture and operation of a drying wire of a thickness of 1.5 mm is fully conventional.

OBJECTS AND SUMMARY OF THE INVENTION

Accordingly, it is an object of the present invention to provide new and improved dryer section in which drawbacks of the prior art are substantially eliminated.

It is another object of the present invention to provide a new and improved dryer section utilizing process-technical operations, an improved construction of the dryer section, and an improved construction of drying wires intended for use in a single-wire draw.

It is yet another object of the present invention to provide a new and improved dryer section and method for drying paper in a single-wire draw in which the speed differences between the wire and paper web are adequately compensated for and reduced.

In view of achieving the objectives stated above and others, in the method in accordance with the invention, the difference in speed of the paper web during operation of the dryer section on the turning sectors of the drying cylinders and leading rolls is reduced by dimensioning the structure of the drying wire in the direction of thickness and/or by selecting the materials of the drying wire accordingly. The difference in speed arises from the variations in the speed of the paper-side face of the drying wire between the drying cylinders and leading rolls. In order to form a better paper quality, it is desired to compensate for the speed difference over the turning sectors of the drying cylinders and leading rolls.

In the dryer section and wire group in accordance with the invention, the drying wire has an asymmetric structure in the direction of its thickness. In this manner, a plane of constant speed, i.e., the neutral plane of deflection or bending, is arranged to be placed between the face of the wire placed at the side of the paper and a center plane of the wire, in the direction of thickness of the drying wire.

The problems that are eliminated by means of the present invention and the advantages offered by the advantageous method and device of the invention are manifested with particular emphasis in modern high speed paper machines whose running speeds are or will be in a range of about 900 meters/minute to about 1800 meters/minute, or possibly even higher.

It is important to note that the present invention can be applied either to the manufacture of new paper machines or paper finishing machines or to the improvement of the operation of existing dryer sections. In this regard, the method and wire group in accordance with the present invention can be used to modernize an existing paper machine with a view toward increasing the running speed yet maintaining,or even improving, the quality of the paper or board.

In the following, the invention is generally described with reference to horizontal multi-cylinder dryers of paper machines, i.e., dryer sections having long horizontal rows of drying cylinders. However, the method and device in accordance with the invention can also be applied in various paper finishing machines, such as coating devices or size presses, for example in their intermediate dryers or elsewhere. The invention can also be applied to multi-cylinder dryers in which the drying cylinders and leading rolls in the cylinder groups are placed in vertical rows or in inclined rows.

Moreover, it should be emphasized that, although, in the following, the invention is described with reference to a construction in which unheated leading rolls, preferably suction-leading rolls, are used in combination with heated drying cylinders, the scope of the invention also includes such older dryer sections having corresponding drying cylinders instead of leading rolls. The scope of the present invention also includes dryer sections in which cold cylinders are used in the rows placed one above the other. Such cold cylinders are used especially in paper coating machines.

In addition, it is important to note that for the sake of simplicity, above and in the following, exclusively drying wires have been and will be spoken of and described. However, this term is to be understood generally as referring to all drying fabrics, including such drying fabrics whose structure is similar to a felt, or even press felt as known and used in conventional paper machines.

In prior art devices, drying wires are known whose cross-section in the direction of thickness is asymmetric. However, this asymmetry and the related constructional parameters of the drying wire have been determined by factors other than the reduction and minimization of the differences in speed in a single-wire draw as described in accordance with the present invention.

With respect to asymmetric constructions of wire and felt, reference is made, e.g., to the following patents: U.S. Pat. No. 4,186,780, Swedish Patent No. SE 227,396, and Swedish Patent No. SE 429,769 (corresponding to U.S. Pat. No. 4,446,187).

It is an important aim of the present invention to maintain the speed of the paper-side face of the wire substantially constant. In theory, a constant speed of the paper-side face is the ideal state, but, in practice, it is not fully possible to reach this state.

In theory, the speeds of the web and of the neutral plane (i.e., the constant-speed plane) of the wire are equal based on accepted scientific principles. In practice, shrinkage of the web inside the group, also in the machine direction, produces a minimal difference in speed between the web and the drying wire. The web speed may also become equal to the speed of the paper-side face of the wire. In this situation, depending on the holding forces, the web speed is either the speed of the paper-side face of the wire on a leading-suction roll or the speed of the paper-side face of the wire on a drying cylinder, and possibly even something in between these two speeds.

BRIEF DESCRIPTION OF THE DRAWINGS

In the following, the invention and its theoretical background will be described in detail with reference to the figures in the accompanying drawings and to preferred exemplifying embodiments of the invention illustrated therein.

DETAILED DESCRIPTION OF THE INVENTION

Figure 1:
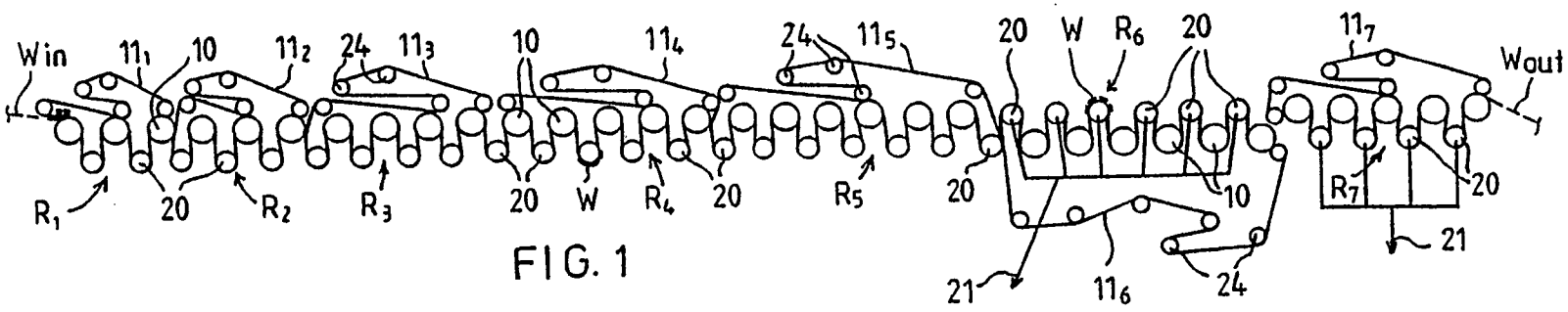
FIG. 1 is a schematic side view of a dryer section which is provided with single-wire draw over its entire length in which the method and device in accordance with the present invention is applied.

Referring to FIG. 1, a paper web W to be dried is passed from a press section of a paper machine to a multi-cylinder dryer at the arrow $W_{in}$. The dryer section comprises seven successive wire groups $R_1, \ldots, R_7$. The dried paper web W is removed from the last wire group $R_7$ in the direction of the arrow $W_{out}$ to a possible reeling or finishing step. At this point, the dry solids content of the web W is a range of about 90% to about 98%, whereas the dry solids content was in a range of about 35% to about 40% on its arrival at the multi-cylinder dryer.

Figure 2:
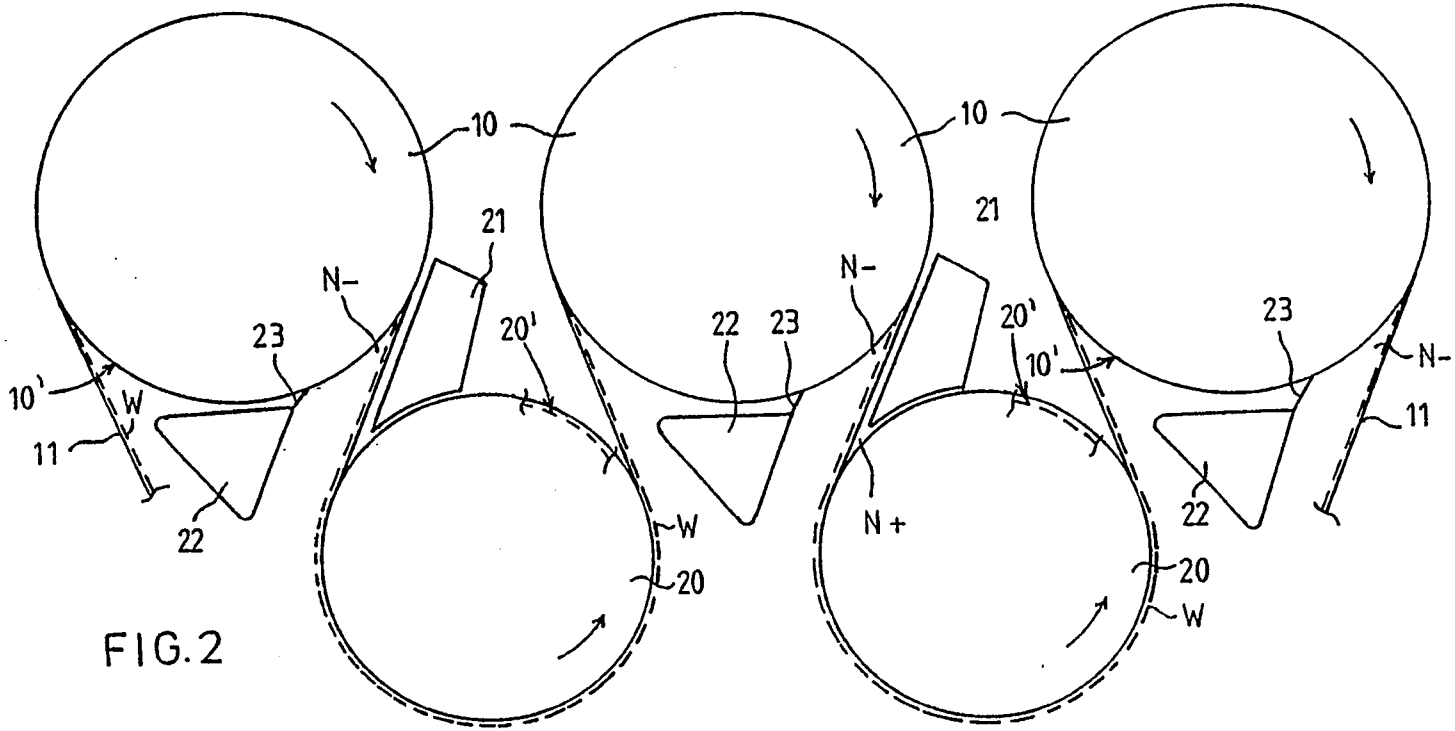
FIG. 2 is an enlarged side view of a part of a wire group having a single-wire draw.

The dryer section shown in FIGS. 1 and 2 consists of heated drying cylinders 10 which have a solid and smooth outer mantle 10', against which the web W to be dried is pressed by means of a drying wire 11. As shown in FIGS. 1 and 2, the drying cylinders 10 are placed outside the loop of the drying wire 11. The drying wire 11 is guided by guide rolls 24. In the gaps between adjacent drying cylinders 10, there are leading-suction rolls 20 arranged inside the loop of the drying wire 11, preferably the assignee's "VACROLL" rolls. The construction of the "VACROLL" is described in the assignee's Finnish Patent Nos. 82,849 and 83,680.

Referring again to FIG. 1, the wires of the different wire groups $R_1, \ldots, R_7$ are denoted with reference numerals $11_1, \ldots, 11_7$. Between the wire groups $11_1, \ldots, 11_7$, the web runs as a closed draw. The wire groups $R_1, \ldots, R_5$ and $R_7$ are so-called normal groups in which the drying cylinders 10 are placed in the upper row and the leading rolls 20 in the lower row. Drying group $R_6$ is a so-called inverted group in which the drying cylinders 10 are placed in the lower row and the leading rolls in the upper row. In FIG. 1, reference numeral 21 denotes the suction ducts of the leading-suction rolls 20. These suction ducts 21 are connected to a vacuum pump in itself known.

The leading rolls 20 are provided with a perforated and grooved mantle 20' through which a negative pressure acts from the interior of the roll 20. This negative pressure promotes the adherence of the web W on the turning sectors of the leading rolls 20 while the web is at the side of the outside curve with no outside support. Doctors 22 are arranged to operate against the lower faces of the drying cylinders 10 and include blades 23 which keep the cylinder faces 10' clean and free of debris. Blow boxes 21 are arranged to operate on the joint straight runs of the drying wire 11 and the web W from the drying cylinder 10 to the leading roll. By means of the blow boxes 21, attempts are made to prevent the formation of differences in pressure in the opening nip spaces N− and in the closing nip spaces N+. Any such differences have the detrimental effect of attempting to separate the web W from the wire 11.

The dryer section illustrated in FIGS. 1 and 2 and described above is in itself known, and it is described in this connection as a background for the invention and as a typical and preferred environment of application. However, the method and device in accordance with the invention may be applied in numerous other applications in which a drying wire meanders between cylinders.

Figure 3:
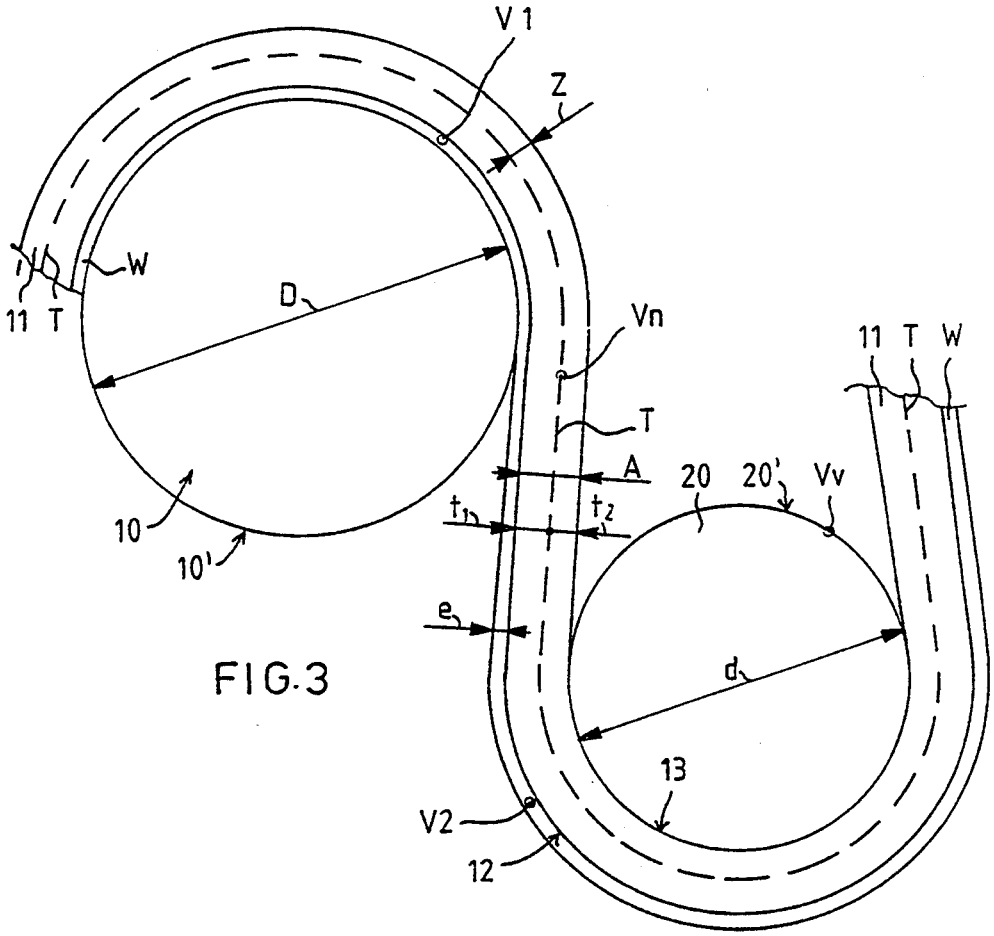
FIG. 3 is a schematic illustration of the important parameters in the present invention regarding the thickness of the web and the wire on an exaggerated scale.

Referring to FIG. 3, the theoretical background of the invention will be described. The reference characters in FIG. 3 are as follows:

D=diameter of drying cylinders 10
d=diameter of leading-suction rolls 20
A=thickness of drying wire
e=thickness of paper web W
N=percentage of asymmetry of drying wire
$t_1$=distance of the constant-speed plane, i.e., of a neutral plane T—T during bending, of the drying wire 11 from a paper-side face 12 of the drying wire 11
$t_2$=distance of the wire plane T—T from a face 13 of the drying wire 11 placed at the side of the mantle 20' of the leading-suction roll 20
$V_1$=speed of the paper web W on drying cylinder 10
$V_2$=speed of the paper web W on leading roll 20
$V_n$=speed of the neutral plane T—T of drying wire 11
$V_s$=speed of the cylinder face 10' of drying cylinder 10
$V_v$=speed of the cylinder face 20' of leading roll 20
Z=distance of the neutral plane T—T from an inner face of the loop of the drying wire Between the quantities and variables listed above, the following equations can be derived:

$$Z=(N\%)\cdot A \quad (1)$$

$$t_1=(1-N)\cdot A \quad (2)$$

$$t_2=N\cdot A=Z \quad (3)$$

$$V_n = V_v(d+2Na)/d \quad (4)$$

$$V_n = V_s(D+2e+2A\cdot(1-N))/D \quad (5)$$

$$V_1 = V_n\cdot(D+e)/(D+2A\cdot(1-N)+2E) \quad (6)$$

$$V_2 = V_n\cdot(d+2A+e)/(d+2NA) \quad (7)$$

$$V_2 - V_1 = V_n \cdot \frac{d+2A+e}{d+2NA} - \frac{D+e}{D+2A\cdot(1-N)+2e} \quad (8)$$

$$V_2 - V_s = V_n \cdot \frac{d+2A+e}{d+2NA} - \frac{D}{D+2Q\cdot(1-N)+2e} \quad (9)$$

$$V_s - V_v = V_n \frac{D}{D+2e+2A(1-N)} - \frac{d}{d+2NA} \quad (10)$$

In the following description, the location of the neutral plane of the wire and its asymmetry in accordance with the invention is defined as a percentage of asymmetry N. The variable N is defined as the distance of the neutral plane from the face of the bottom side (non-paper side) of the wire as a percentage of the thickness t of the wire. Thus, in a fully symmetric wire, N is about 50%, and in the ideal state aimed at in the invention, N is about 100%. It is also apparent that the percentage of asymmetry N determines the thickness of each portion of the drying wire.

In accordance with the invention, it is an ideal situation that the neutral plane of bending of the wire, i.e., the constant-speed plane, is in the plane of the face of the wire that is placed against the paper. As the neutral plane is moved further away from the constant-speed plane, the worse the situation become vis a vis the speed differences. In practice, a value of percentage of asymmetry N, mentioned above, can be reached that is in a range of about 90% and even higher. The goals of the present invention are consistently approached when the percentage of asymmetry N is greater than about 50%, and the advantage that is obtained depends on the thickness of the wire used in the dryer section. In practice, however, the advantages provided by the invention are already manifested significantly when N is greater than about 60%.

In the formulae given above (1)-(10), for the sake of simplicity, the percentage of asymmetry N is given as a decimal number, so that if N equals 50%, N is represented by 0.5, and, for example, if N equals 80%, N in the equations would be 0.8.

In the following, an example of calculation will be given with the equations (1) to (10) given above while assuming the following typical starting values:

D=1.83 m
d=1.5 m
A=1.5 mm
e=0.1 mm
$t_1=t_2$

Thus, above, it has been assumed that the drying wire 11 has a symmetric structure ($t_1=t_2$, so that N=0.5) and the paper web W is fully elastic in the machine direction. With the values given above, theoretically, it is possible to calculate the following differences in speed:

$V_2-V_1=1.9$ m/min.

$V_2-V_s=2.0$ m/min.

$V_s-V_v=0.07$ m/min

The speeds $V_s$ and $V_v$ can be measured highly accurately. The theoretical computations given above are substantially in agreement with practical measurements in the drying groups 1 to 6 in the dryer section described above in relation to FIG. 1, and also in drying group 7 when the paper web W is not running on the drying wire.

Figure 4:
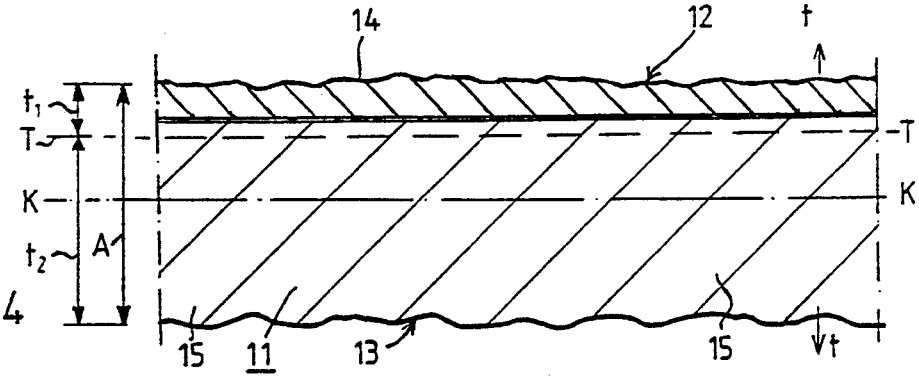
FIG. 4 is a sectional illustration of an asymmetric drying wire that is employed in the method and device in accordance with the invention.

FIG. 4 is a schematic sectional view of an asymmetric drying wire 11 utilized in the present invention and constructed asymmetrically so that its constant-speed plane, i.e., neutral plane T—T of bending is between a paper-side face 12 of the wire 11 and the center plane K—K of the wire in the direction of thickness of the wire. In FIG. 4, the wire 11 is shown schematically as composed of two layers 14 and 15. The outer face of the layer 14 forms the face 12 of the drying wire 11 that is placed against the paper W, while the outer face of the other layer 15 forms the face 13 that is placed against the cylinder faces 20' on the leading cylinders 20. The layer 14 is substantially thinner than layer 15, and the modulus of elasticity of the layer 14 is substantially higher than the corresponding modulus of elasticity of the layer 15. Thus, the neutral plane T—T of bending can be defined as the plane in which a pressing strain is converted to tensile strain in the direction of thickness of the wire 11, when bending in a non-prestressed state.

In the present invention, the percentage of asymmetry N defined above in the equation (1) is greater than about 50%, typically between about 60% and about 99%, and preferably between 70% and 95%. An asymmetric drying wire 11 in accordance with the invention has, of course, the other properties suitable for a drying wire 11, such as the properties of smoothness and adhesion of the face 12 placed against the web W, and permeability, which is typically in a range of about 1000 $m^3/hm^2$ to about 2000 $m^3/hm^2$ (cubic meters per hour per square meter). Normally, a rear face 13 of an asymmetric wire in accordance with the invention tends to become coarser, so that it carries an increased amount of air along with it into the closing nip spaces N+ between the drying wire 11 and the leading-suction roll 20. For this purpose, it is preferable to use blow boxes 21 as illustrated in FIG. 2. Such blow boxes are marketed by the assignee under the trade mark "UNO RUN BLOW BOX".

According to present-day knowledge, generally no other particular requirements have to be imposed on an asymmetric wire 11 in accordance with the invention.

Figure 5:
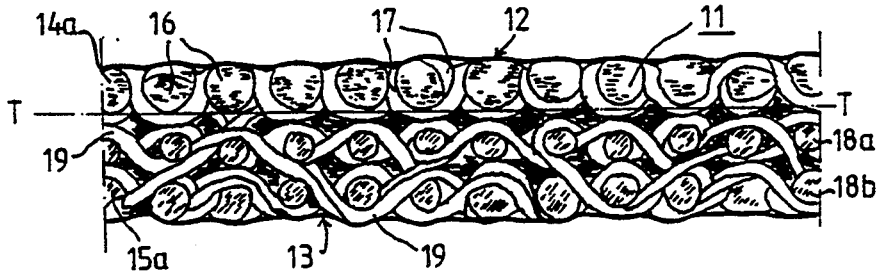
FIG. 5 is a sectional view in the machine direction of an asymmetric construction of a drying wire that is employed in the method and device in accordance with the invention.

FIG. 5 is a sectional view of an asymmetric wire applied in the device and method of the present invention in which the neutral plane T—T of the drying wire is at the side of the paper-side face 12 of the wire 11. The wire 11 consists of three integrated layers of wefts **14*a*, 18*a* and 18*b*. The wefts 14*a* in the face 12 at the side of the paper W are interconnected by means of warps 17 so that the modulus of elasticity of the layer 14*a* is substantially higher than the modulus of elasticity of the layers 18*a* and 18*b*. In the layers 18*a* and 18*b*, there are relatively "loose" warps 19**. For the warps and wefts, it is possible to use suitable plastic and/or metal materials so that an asymmetric wire unit in accordance with the invention is obtained which has properties also in other respects suitable for a drying wire used in a drying section having a single-wire draw.

Figure 6:
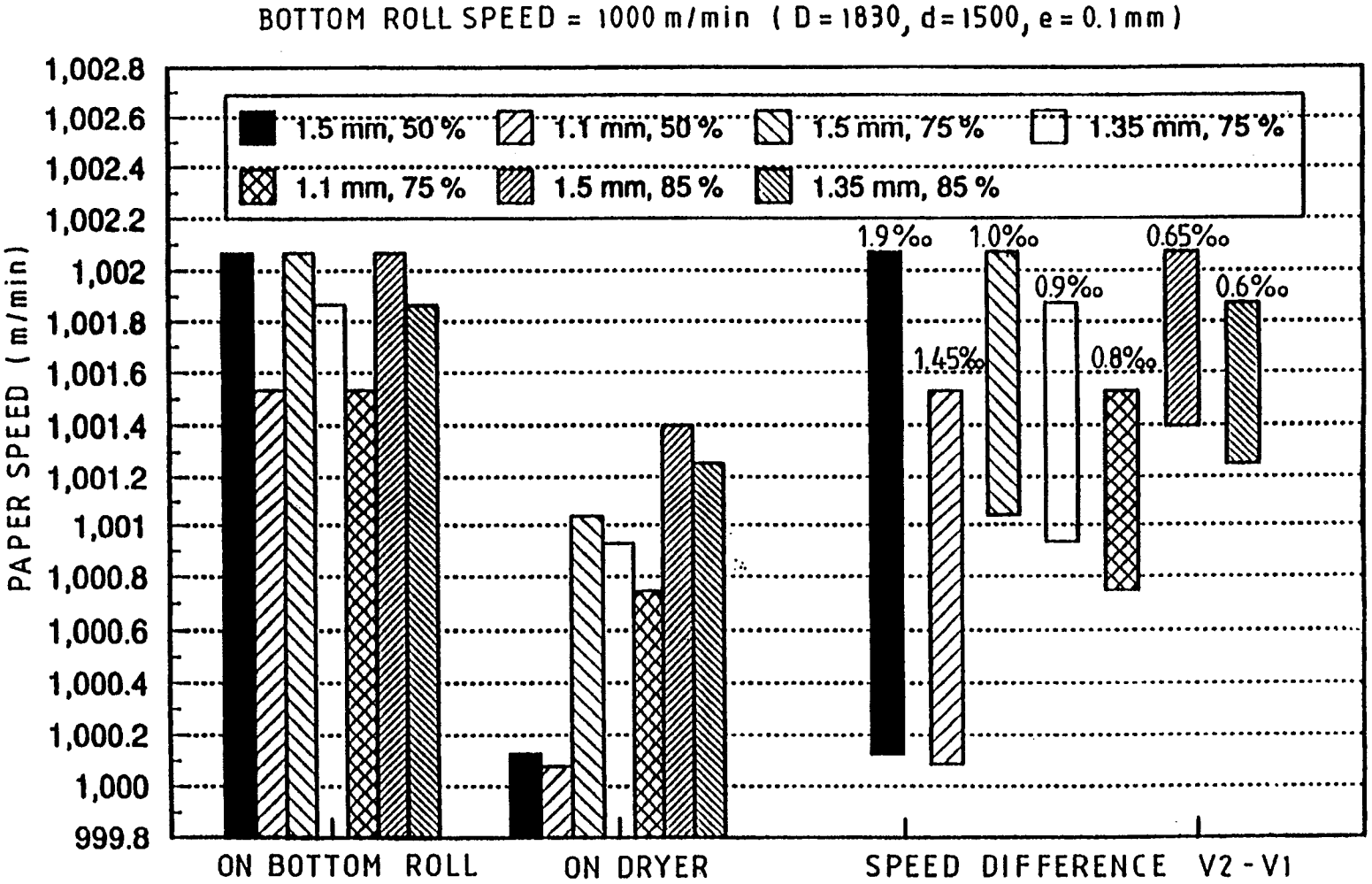
FIG. 6 is a diagram illustrating paper speeds on a leading-suction roll and on a drying cylinder in a single-wire draw and the differences of the speeds with wires having different thicknesses and different asymmetries.

FIG. 6 is a column diagram that illustrates the theoretically calculated speeds of paper in a single-wire draw when the circumferential speed $V_v$ of the suction roll 20 is about 1000 m/min, the diameter D of the drying cylinder is about 1830 mm, and the diameter d of the leading-suction roll 20 is about 1500 mm. The vertical axis of FIG. 6 represents the running speed of the paper W in units of meters per minute (m/min). The first group of columns represents the speed $V_2$ of the paper on the leading-suction roll 20 with different thicknesses of the drying wire (e.g., A is about 1.1 mm, A is about 1.35 mm, and A is about 1.5 mm), and with three different percentages of asymmetry (e.g., N is about 50%, N is about 75%, and N is about 85%). A corresponding series of five columns is shown concerning the speeds $V_1$ on the dryer cylinder 10. At the right side of the column diagram, the differences in speed $V_2-V_1$ corresponding to speeds $V_2$ and $V_1$ are given. From this data, it is noted that, when the asymmetry of a drying wire 11 which is about 1.5 mm thick is increased from the value N is about 50% to the value N is about 85%, the difference in speed $V_2-V_1$ is lowered from about 1.9 per mille to about 0.65 per mille. In a corresponding way, when the asymmetry of a drying wire which is about 1.1 mm thick is increased from about 50% to about 75%, the difference in speed $V_2-V_1$ is lowered from about 1.45 per mille to about 0.8 per mille (per thousand).

Figure 7:
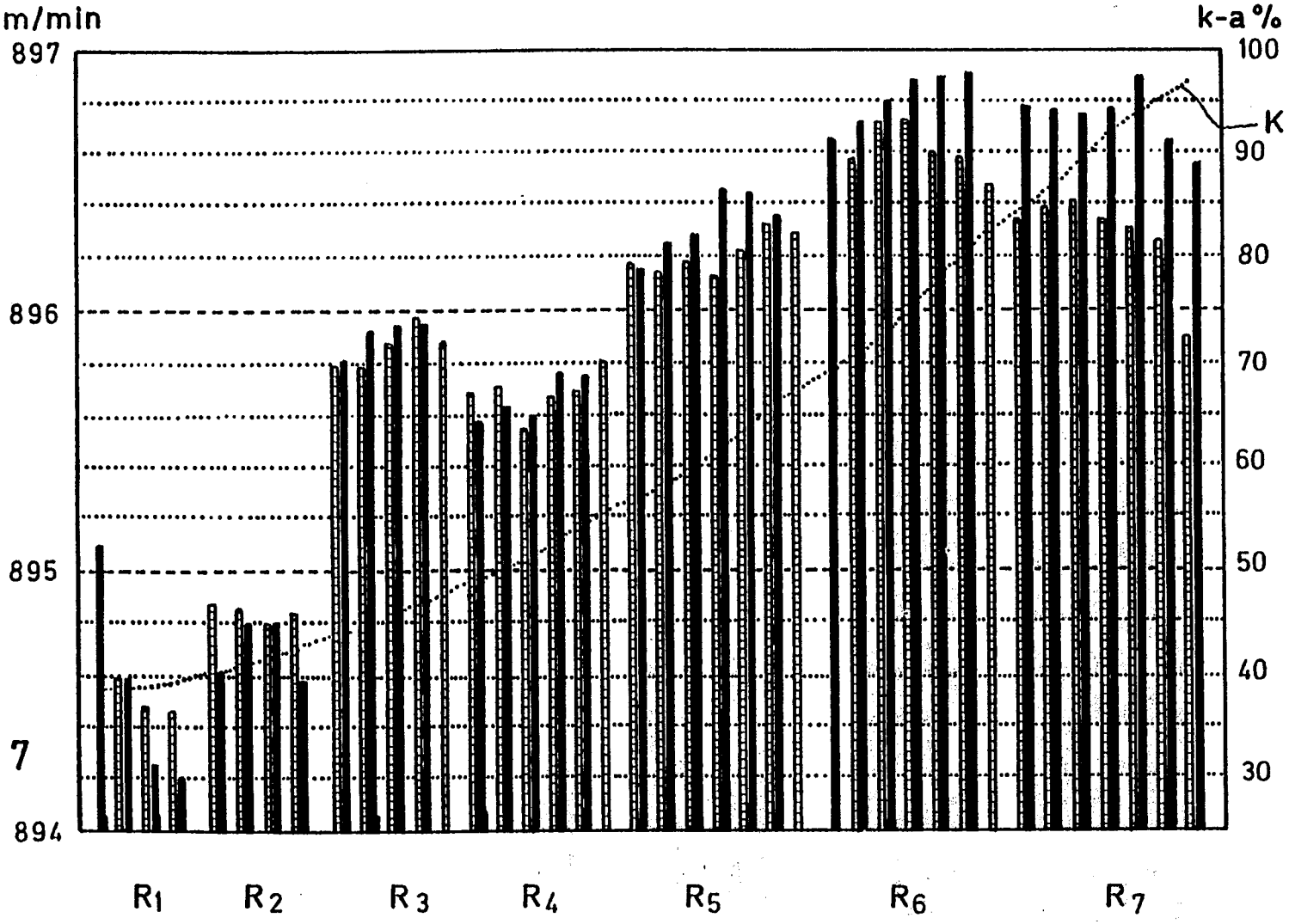
FIG. 7 illustrates the speeds of drying cylinders and adjacent leading suction rolls in different wire groups in a dryer section provided with seven single-wire groups, similar to that illustrated in FIG. 1, as well as a simulated development of the percentage of dry solids content (k-a)% of the web.

FIG. 7 illustrates the measured circumferential speeds $V_s$ of the dryer cylinders 10 and the corresponding circumferential speeds $V_v$ of the leading-suction cylinders 20 (the black column is $V_s$ and the diagonally shaded column is $V_v$). In the groups $R_1, \ldots, R_6$, there is essentially no difference in speed ($V_s-V_v$) which is noticeable because in these groups, the paper web is sufficiently elastic. However, as shown in FIG. 7, the speeds in the drying group R7 behave in contradiction with the presented theory, because, in group $R_7$, on the freely revolving drying cylinders 10, speeds occur that are higher than would result from the applicable theory. This is an indication of the specific problems arising from differences in speed that are eliminated by means of the present invention.

In FIG. 7, the simulated dry solids content K as a percentage is indicated by a dashed line (right vertical axis). The problems and drawbacks that are substantially eliminated by means of the present invention are evident after the dry solids content K has reached the value of about 60% to about 65%. At dry solids contents higher than this, the advantages of the use of an asymmetric wire 11 in accordance with the present invention are manifested with particular emphasis.

TEST EXAMPLE

By means of speed measurements with the first dryer group of the assignee's test paper machine at Rautpohja, Finland, attempts were made to find out whether it is possible to reduce the detrimental difference in speed between the wire and the paper web by making use of an asymmetric structure of the drying wire, such as described in the present application. In the measurements, a wire of twin-wire draw was employed that had an asymmetric structure and could be assumed to operate in an asymmetric way. Herein, by means of asymmetry, it was desired to reach a situation in which the speed of the paper-side face of the wire remains substantially invariable as possible in the dryer group. The asymmetric test wire was run with the normal paper side of the wire in the wire loop both outward and inward in order to confirm the results. With a drying wire normally used in the test machine, additional reference measurements were carried out.

In the measurements thus obtained, the percentages of asymmetry N of the test wire were noticed to be from about 31% to about 38% with the wire running one way, and from about 71% to about 76% with the wire running the other way. With the reference wire, the values in a normal operation of the dryer group were from about 43% to about 50%, i.e., the reference wire was substantially symmetric. The value of asymmetry represents the distance of the constant-speed line of the wire, i.e., of the neutral plane of bending, from the face of the wire placed at the side of the suction leading roll, so that the entire thickness of the wire is represented by the percentage number 100%.

The results described above indicate that it is possible to affect the differences in speed between the wire face and the paper web by means of asymmetry of the structure of the drying wire. With a typical drying wire (e.g., having a thickness t of about 1.5 mm), the theoretical difference in speed between the wire face and the paper web in a normal "Sym-Run" draw is about 2 per mille. With a wire whose asymmetry N is about 72%, the difference in speed would be about 1.1 per mille, which means a noticeable reduction in the wear of the drying wire.

An asymmetric wire in accordance with the invention that is best suitable for single-wire draw has preferably a degree of asymmetry higher than that of the wire described and tested above. A value of asymmetry N of about 85% of the drying wire permits a speed difference between the paper and the drying wire as little as about 0.6 per mille (when the thickness t of the wire is about 1.5 mm).

As described above, the present invention can be applied in a dryer section in a paper machine in which a plurality of wire groups are arranged in a row one after another as illustrated in FIG. 1. At least one of the wire groups may be a wire group in accordance with the invention which is preferably arranged at an end of the dryer section where the dry solids content of the paper web is greater than about 60%.

The examples provided above are not meant to be exclusive. Many other variations of the present invention would be obvious to those skilled in the art, and are contemplated to be within the scope of the appended claims.

I claim:

1. A method in a dryer section provided with a single-wire draw in a paper machine or paper finishing machine, comprising the steps of:

arranging drying cylinders having heated cylinder faces in a dryer group of a dryer section, arranging leading rolls in the dryer group in proximity to said drying cylinders, providing a drying wire to run over said drying cylinders and leading rolls, said drying wire having an asymmetric structure in a direction of its thickness such that a plane of constant speed, defined as a neutral plane of bending, is arranged in the direction of thickness of said drying wire between a paper-side face of said drying wire on which a paper web runs and a center plane of said drying wire, and passing the paper web to be dried on support of said drying wire alternatingly over said drying cylinders and said leading rolls, the paper web running on said paper-side face of said drying wire over a first turning sector of said drying cylinders in direct contact with said heated cylinder faces at a first speed and over a second turning sector of said leading rolls at a second speed such that said first speed substantially approximates said second speed during operation of the dryer section, the difference between said first speed and said second speed arising from variations in the speed of said paper-side face of said drying wire between said drying cylinders and said leading rolls.

2. The method of claim 1, further comprising the step of applying a drying wire having an appropriate cross-section to provide the asymmetric structure of said drying wire.

3. The method of claim 1, wherein said drying wire has a percentage of asymmetry N in the direction of its thickness in a range of about 60% to about 99% to thereby provide the asymmetric structure of said drying wire, said percentage of asymmetry being defined as Z/A, wherein Z is the distance of said neutral plane of bending of said drying wire from an inner face of said drying wire opposite to said paper-side face, and A is the thickness of said drying wire.

4. The method of claim 3, wherein said percentage of asymmetry is in a range from about 70% to about 95%.

5. The method of claim 1, further comprising the steps of applying a drying wire having an appropriate cross-section and selecting the materials of said drying wire to provide the asymmetric structure of said drying wire.

6. The method of claim 5, wherein the cross-section of said drying wire and the materials of said drying wire are selected such that the difference between said first speed and said second speed is in a range of about 0.1 per mille to about 1.5 per mille of the circumferential speed of said leading rolls.

7. The method of claim 5, wherein the cross-section of said drying wire and the materials of said drying wire are selected such that the difference between said first speed and said second speed is in a range of about 0.5 per mille to about 1.0 per mille of the circumferential speed of said leading rolls.

8. The method of claim 1, further comprising the step of arranging the dryer group in a multi-cylinder dryer of a paper machine where the dry solids content of the paper web is greater than about 60% to about 65%.

9. The method of claim 1, further comprising the step of selecting the materials of said drying wire to provide its asymmetric structure.

10. A wire group in a multi-cylinder dryer section in a paper machine, comprising smooth-faced and solid-mantle heated drying cylinders having heated cylinder faces, leading rolls or equivalent suction cylinders placed in proximity to said drying cylinders, and a single-wire draw guiding a paper web through said dryer section, said single-wire draw comprising a drying wire guided by guide rolls in a loop, said drying wire passing over said drying cylinders and said leading rolls such that said drying cylinders are placed outside said drying wire loop and said leading rolls are placed inside said drying wire loop, the paper web to be dried running on said drying wire and being pressed by said drying wire against said heated cylinder faces of said drying cylinders, said drying wire having an asymmetric structure in a direction of its thickness such that a plane of constant speed, defined as a neutral plane of bending, is arranged in the direction of thickness of said drying wire between a paper-side face of said drying wire on which the paper web runs and a center plane of said drying wire., said drying wire reducing the difference in speed arising from variations in the speed of said paper-side face of said drying wire between said drying cylinders and said leading rolls.

11. The wire group of claim 10, wherein said drying wire has a percentage of asymmetry N in the direction of thickness defined as Z/A in a range of about 60% to about 99%, wherein Z is the distance of the neutral plane of bending of said drying wire from an inner face of said drying wire opposite to said paper-side faces, and A is the thickness of the drying wire.

12. The wire group of claim 11, wherein said percentage of asymmetry N is in a range of about 70% to about 95%.

13. The wire group of claim 11, wherein the thickness A of said drying wire is in a range of about 0.3 mm to about 5 mm.

14. The wire group of claim 13, wherein the thickness A of said drying wire is in a range of about 0.5 mm to about 2.5 mm.

15. The wire group of claim 10, wherein the wire group is arranged in the multi-cylinder dryer of the paper machine where the dry solids content of the paper web is greater than about 60% to about 65%.

16. The wire group of claim 10, wherein said drying wire comprises three integrated layers of wefts, a first one of said layers closest to said paper-side face of said drying wire being interconnected by warps such that the modulus of elasticity of said first layer is greater than the modulus of elasticity of a second and third one of said layers.

17. The wire group of claim 16, wherein said second and third layers are interconnected by warps looser than said warps interconnecting said first layer and said warps and wefts of said first, second and third layers comprise suitable plastic and/or metal materials such that said drying wire is provided with an asymmetric structure.

18. A dryer section in a paper machine comprising a plurality of wire groups arranged in a row one after another, at least one of said plurality of wire groups comprising a wire group as claimed in claim 10.

19. The dryer section of claim 18, wherein said at least one wire group is arranged at an end of said dryer section wherein the dry solids content of the paper web is greater than about 60% to about 65%.

20. A method for drying a paper web in a dryer section of a paper machine or paper finishing machine, the dryer section having a single-wire draw and including drying cylinders and leading rolls arranged in proximity to said drying cylinders, comprising the steps of:

providing a drying wire to run over said drying cylinders and leading rolls, said drying wire having an asymmetric structure in a direction of its thickness such that a plane of constant speed, defined as a neutral plane of bending, is arranged in the direction of thickness of said drying wire between a paper-side face of said drying wire on which a paper web runs and a center plane of said drying wire, and passing the paper web to be dried on support of said drying wire alternatingly over said drying cylinders and said leading rolls.

* * * * *